US005203517A

United States Patent [19]

Parry et al.

[11] Patent Number: 5,203,517

[45] Date of Patent: Apr. 20, 1993

[54] STRETCH-WRAP FILM DISPENSER WITH CYLINDRICAL BEARINGS

[76] Inventors: John C. Parry, 616 Cape McKinsey Dr.; Daniel J. Parry, 553 Center Dr., both of Severna Park, Md. 21146

[21] Appl. No.: 920,523

[22] Filed: Jul. 28, 1992

Related U.S. Application Data

[63] Continuation of Ser. No. 635,825, Jan. 3, 1991, abandoned.

[51] Int. Cl.[5] ..... B65H 23/08; B65H 75/02

[52] U.S. Cl. ..... 242/96; 242/99

[58] Field of Search ..... 242/96, 99, 75.4

[56] References Cited

U.S. PATENT DOCUMENTS

| | | | |
|---|---|---|---|
| 1,415,678 | 5/1922 | Moynihan | 242/96 |
| 4,179,081 | 12/1979 | Parry | 242/96 |
| 4,248,392 | 2/1981 | Parry | 242/96 |
| 4,484,717 | 11/1984 | Goldstein | 242/96 |
| 4,722,493 | 2/1988 | Parry et al. | 242/96 |
| 4,784,348 | 11/1988 | McDonald | 242/96 |
| 4,817,762 | 4/1989 | Powell | 242/96 |
| 4,834,312 | 5/1989 | Riemenschneider, III | 242/96 |

*Primary Examiner*—Daniel P. Stodola
*Assistant Examiner*—John Q. Nguyen
*Attorney, Agent, or Firm*—Shoemaker and Mattare, Ltd.

[57] ABSTRACT

A dispenser for a roll of stretch-wrap film enables the operator to apply variable tension to the end of the unwinding film. The dispenser has a spindle the end of which forms a hub which attaches securely to the core of the film roll, and rotates with the roll as the film is unwound. The spindle extends coaxially from the core of the film roll and is partially surrounded by a flexible hand grip. Bearings are coaxially mounted on the spindle and interposed beneath part of the hand grip, so that the spindle may rotate freely with respect to the hand grip. Part of the hand grip engages the spindle without interposition of bearings, so that the application of radial hand pressure results in frictional braking torque on the unwinding film roll, which enables tension to be applied to the end of the film.

14 Claims, 4 Drawing Sheets

STRETCH-WRAP FILM DISPENSER WITH CYLINDRICAL BEARINGS

This is a continuation of copending application Ser. No. 07/635,825, filed on Jan. 3, 1991, now abandoned.

BACKGROUND OF THE INVENTION

This invention relates to the field of stretch-wrap film packaging, in particular to a tool for dispensing highly stretchable plastic film for use in packaging.

The development of the stretch film wrap industry has brought about a need for devices capable of paying out film under variable tension as it is wrapped around a package or object or group of objects to be packaged together. Typically, such stretch-wrap film is supplied in rolls wound around a hollow core, and the film is unwound from the roll as it is applied. It is necessary as the film is unwound to apply a degree of tension to the unwinding end of the film so that the film will be somewhat stretched as it comes into contact with the object being packaged. For various reasons, it is desirable that the operator be easily able to control the degree of tension applied.

A number of such devices are already known. U.S. Pat. Nos. 4,179,081 and 4,248,392 issued Dec. 18, 1979 and February, 1981, respectively, to John C. Parry disclose devices with a flexible hand grip that is squeezed to exert a braking force to the core of a roll of film, whereby the operator may control the amount of tension on the film as it unrolls by varying the magnitude of pressure on the hand grip. These devices work particularly well with wider film rolls of 10 inches or greater with one such device at either end of the roll.

Tools for dispensing narrower stretch-wrap films, for example, those from one to five inches wide have also been made. With such narrower films, one-handed operation is often possible and more convenient. The Parry devices disclosed in the above-mentioned patents may be used for one-handed operation, but it has been found that the twisting torque resulting from one-handed operation may cause binding between the roll core and the hand grip, and a degree of loss of control of the tension.

U.S. Pat. No. 4,722,493 issued February, 1988 to Daniel J. Parry and John C. Parry discloses a device which uses the type of hand grip as discussed above and is well suited for one-handed operation. In this device, the roll core is engaged by a spindle which is freely rotatable with respect to a cylindrical handle. The flexible hand grip covers the handle and a collar attached to the spindle. With free rotation between the spindle and the handle, binding is avoided because the handle turns with the hand grip. Braking force is applied by the thumb and forefinger against the collar. It has been found, however, that in extended use with this type of arrangement the thumb and forefinger may become fatigued, resulting in a temporary impairment of ability to control the application of tension to the film.

U.S. Pat. No. 4,834,312 issued May 30, 1989 to Paul K. Riemenschneider discloses a dispenser wherein a head is affixed to a roll of film and a spindle extends from the head. A split cylinder forms a grip surrounding the spindle, and may be squeezed to exert frictional braking pressure. However, because the braking force is applied generally along the length of the spindle, this dispenser also tends to bind as a result of the twisting torque which results from one-handed operation.

Other more elaborate dispensers have also been made. It is desirable, however, that such devices be of simple, lightweight and inexpensive construction. In practice, such tools are easily lost or destroyed and through extensive use may require relatively frequent replacement. Lightness of weight is desirable to enable constant use without unnecessary expenditure of energy and resultant fatigue.

SUMMARY OF THE INVENTION

The present invention is a simplified improvement over the dispenser disclosed in U.S. Pat. No. 4,722,493, which may be constructed of inexpensive lightweight materials, easily manufactured and assembled. When in use, the subject simplified dispenser utilizes a drum brake principle similar to that of the dispenser of U.S. Pat. No. 4,722,493. In the dispenser of the present invention, bearings are used to eliminate the problem of binding, and such bearings may be arranged so that the radial force on the drum brake may be applied through the middle fingers and palm of the hand, avoiding the fatigue resulting if the force always originates from the thumb and forefinger.

The invention is directed to a dispenser for a roll having a core around which is wound a quantity of stretch-wrap film. A spindle has an end portion adapted for secure attachment to the core of the roll so that the spindle extends coaxially from the core of the roll and rotates together with the roll. The spindle also has a handle portion having a middle segment of suitable diameter for hand-gripping, an outer segment adjacent the middle segment on the side opposite the roll, and an inner segment adjacent the middle segment on the side nearest the roll. Outer and inner bearings, having an outside diameter of suitable diameter for hand-gripping, coaxially engage the outer and inner segments, respectively, and rotate freely with respect to the spindle.

A flexible hand grip surrounds the handle portion for transmitting radial hand pressure to it, and is dimensioned so that the spindle rotates freely with respect to the hand grip when no radial hand pressure is applied at the surface of the middle segment, and so that a frictional braking torque is exerted on the spindle when radial hand pressure is applied at the surface of the middle segment.

In another embodiment, the handle portion has only a first segment of suitable diameter for hand-gripping and a second segment axially adjacent the first segment. A bearing, having an outside diameter of suitable diameter for hand-gripping, coaxially engages the second segment and freely rotates with respect to the spindle.

In further embodiments, the outer and inner segments are of lesser diameter than that of the middle segment, and the outside diameter of the bearings is substantially equal to the diameter of the middle segment.

The outside diameter of the inner bearing may be greater than the diameter of the first segment.

The handle portion may be formed of a cylindrical shaft of substantially uniform diameter, the first segment being formed of a hollow braking cylinder rigidly secured to the shaft, and the bearings may be rigid cylinders of inside diameter greater than the diameter of the shaft.

The end portion of the spindle may be a hub of diameter slightly larger than the inside diameter of the core of the roll whereby the hub may be forcibly inserted into the core for frictional engagement therewith. The hub may have longitudinal ridges for positive rotational engagement with the core.

DESCRIPTION OF THE PREFERRED EMBODIMENTS

Figure 1:
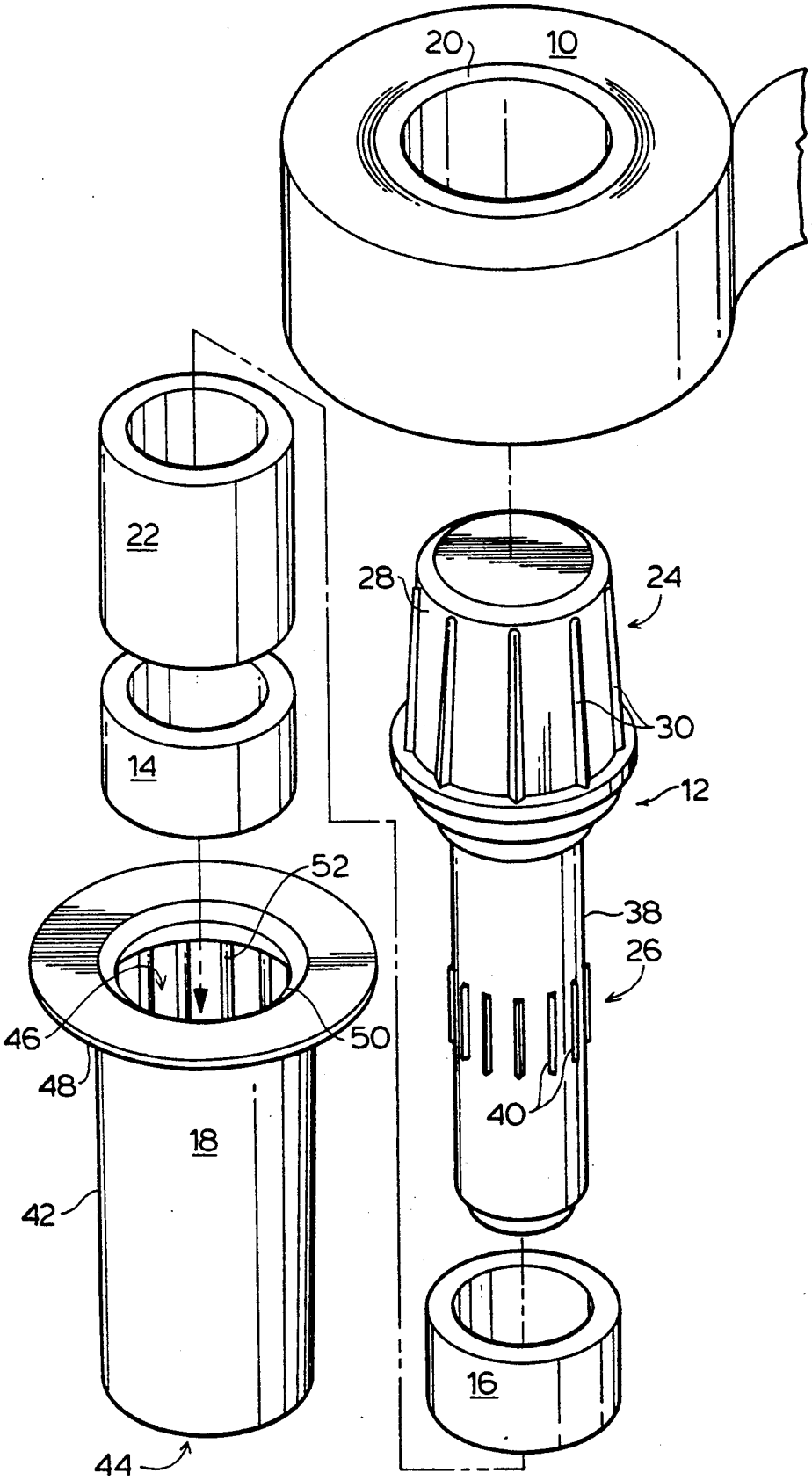
FIG. 1 is an exploded perspective view of a preferred embodiment of the subject invention.

Typically, rolls of stretch-wrap film have a rigid hollow cylindrical core 20, as shown in FIG. 1. Such core material may be made of cardboard which is impregnated with glue and then wound around a removable mandrel. This core material may also be used in the construction of the simplified dispenser of the invention.

Having reference first to FIG. 1, in the preferred embodiment, the simplified dispenser for a roll of stretch-wrap film 10 is constructed of a spindle 12, two bearings 14,16 preferably formed of cardboard core material, a flexible hand grip 18, and a brake drum 22 preferably formed of cardboard core material. The spindle 12 is preferably formed of blow molded plastics material, for example, rigid polyethylene.

Figure 2:
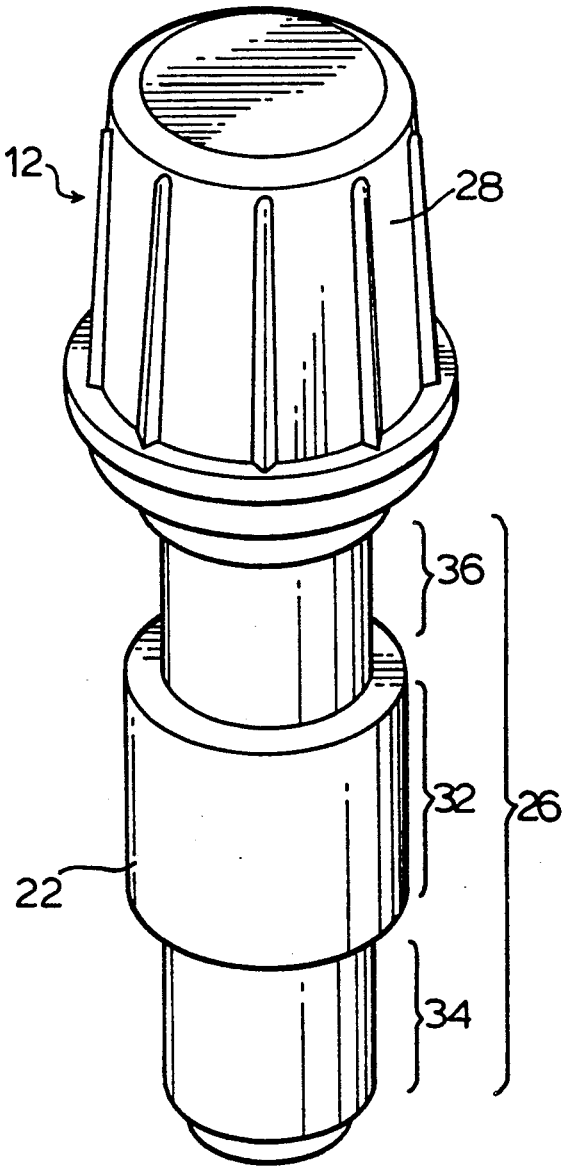
FIG. 2 is a perspective view of the spindle of the invention with the brake drum installed thereon.

The spindle 12 has an end portion 24 and a handle portion 26, designated generally on FIGS. 1 and 2. The end portion 24 of the spindle 12 forms a substantially cylindrical hub 28 or plug appropriately dimensioned for forced insertion by hand into the fibre or paper core 20 of a roll of film. The hub 28 also has protruding longitudinal ridges 30 to positively engage the core 20 and resist relative rotation. For secure attachment to the core 20 of the roll, the outside diameter of the hub 28, including the protruding ridges 30, is slightly greater than the inside diameter of the core 20.

FIG. 2 illustrates the spindle 12 having handle portion 26 extending coaxially from the hub 28, with brake drum 22 installed thereon, to form a middle segment 32 of a diameter suitable for hand-gripping. A diameter of about 1½ inches has been found to be suitable. Two other segments of handle portion 26, designated the outer segment 34 and the inner segment 36 for the purposes of this description, are axially adjacent to and on either side of the middle segment 32. The outer and inner segments 34 36 are of lesser diameter than the middle segment 32 to accommodate the bearings 14, 16. With respect to the middle segment 32, the outer segment 34 is on the side of the spindle opposite the roll 10, and the inner segment 36 is on the side nearest the roll 10.

The handle portion 26 of the spindle 12 is preferably constructed in the following manner. A cylindrical shaft 38, as shown in FIG. 1, of substantially uniform diameter is formed as a unit with the hub 28 or end portion, extending coaxially therefrom. A series of longitudinal ridges or knurls 40 are formed at about the midpoint of the shaft. A brake drum 22 of cardboard core material is pushed onto the shaft to form the middle segment 32, shown in FIG. 2. The brake drum 22 has an inside diameter substantially equal to the outside diameter of the shaft 38, or very slightly greater, so that when the brake drum 22 is forced onto the knurls 40 of the shaft 38, it remains in fixed coaxial engagement with the shaft 38 Frictional forces resist longitudinal movement of the brake drum 22 once installed on the shaft 38.

The length of the cylindrical shaft 38 is suitable to form a handle. About 3¼ to 3½ inches has been found to be appropriate. The middle segment 32 occupies the middle of the shaft 38, leaving two approximately equal unoccupied segments of the shaft, adjacent the middle segment 32, to form the outer and inner segments 34,36. The outer and inner segments 34,36 are of lesser diameter than the diameter of the middle segment 32, and are therefore able to accept outer and inner bearing means 14,16 having an outside diameter suitable for hand-gripping.

Figure 3:
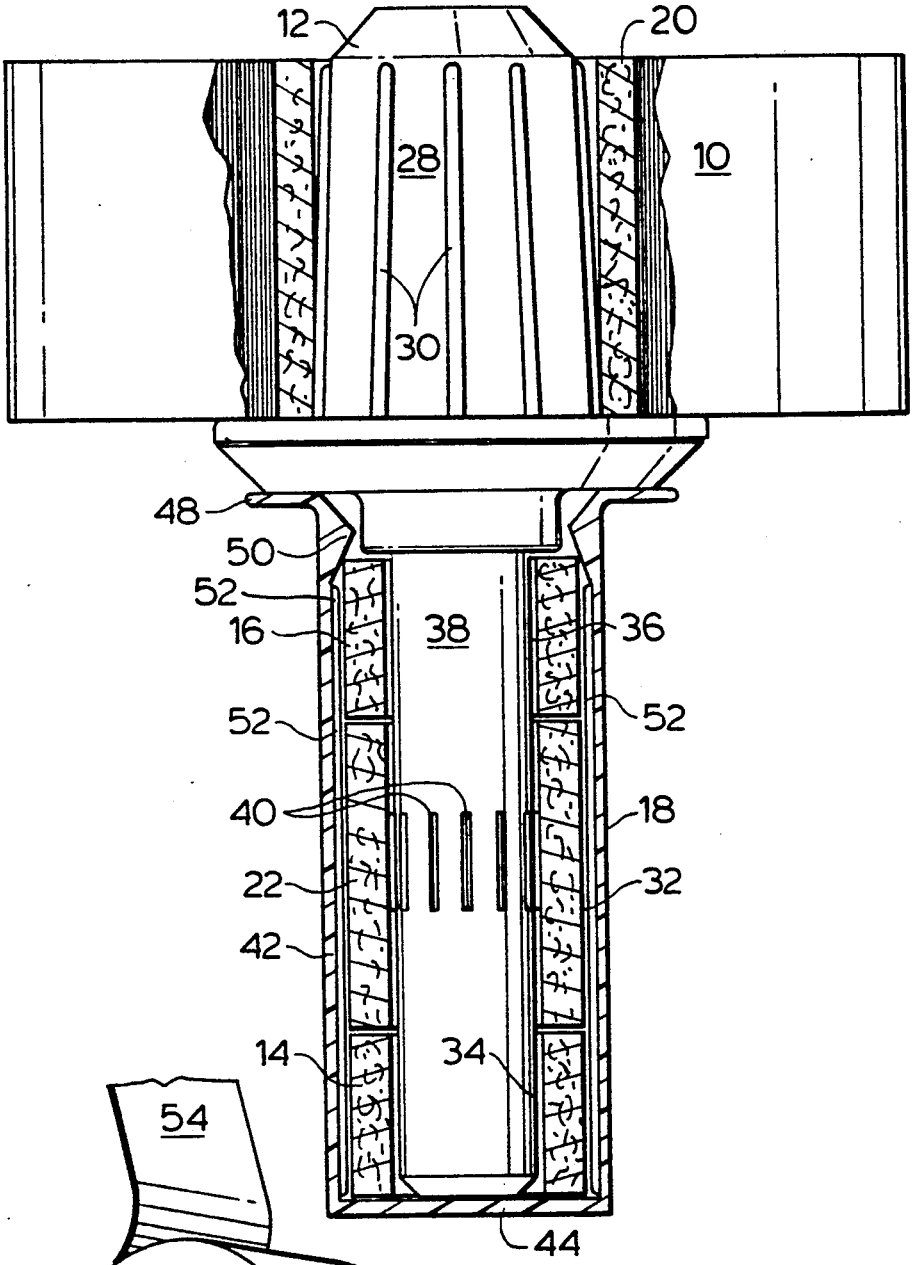
FIG. 3 is a sectional view of the dispenser of FIG. 1.

Referring now to FIGS. 1 and 3, outer and inner bearings 14,16 are formed of hollow rigid cylinders of cardboard core material, having an inside diameter just slightly larger than the diameter of the cylindrical shaft 38 of the handle portion 26 of the spindle 12. The outer and inner bearings 14,16 are inserted coaxially on the shaft 38 to engage the outer and inner segments 34,36, respectively, of the shaft 38, and rotate freely with respect to the shaft 38. In assembling the dispenser, the inner bearing 16 is installed before the brake drum 22 forming the middle segment 32 is installed.

There is a degree of choice in selecting the dimensions of the hollow cylinders of the bearings 14, 16 and the brake drum 22. With respect to the length of the brake drum 22 and of the inner and outer segments 34,36 and bearings the 14,16, the length of the brake drum 22 determines how much braking surface is available for application of radial braking force by an operator's hand. It has been found that in the case of high-strength three-inch wide stretch film, a suitable ratio of braking surface to non-braking surface is obtained, if the brake drum 22 is in the range of 1½ to 2 inches, and the length of each of the outer and inner bearings 14,16 is in the range of ¾ to 1 inch, but the dimensions of these hollow cylinders are not limited to the aforesaid ranges. The length of braking surface will depend upon, inter alia, the length of the roll of stretch film and the strength of the film itself.

It is an advantage of the present, simplified construction that whatever ratio of braking surface to non-braking surface is chosen at the time of manufacture may subsequently be modified by replacement of the bearings 14,16 and the brake drum 22 forming the middle segment 32. Thus, to obtain a greater or lesser ratio of braking surface, one may simply remove and replace the aforesaid three hollow cylinders with differently dimensioned ones. The selection of a preferred ratio of braking surface may depend on such factors as the hand strength of the operator and the width of the film being used. Similarly, the relative lengths of the outer and inner bearings 14,16 (and corresponding outer and inner segments 34,36) need not be equal, but may be selected according to the preference of the operator.

With respect to the diametrical dimensions, it is required that the inside dimensions of the bearings 14,16 be such that the bearings rotate freely on the shaft 38, and further that the outside diameters of the bearings 14,16 and brake drum 22 be suitable for hand-gripping. Apart from these requirements, there is a range of latitude. It is possible, for ease of manufacture, that the same core material be used for the bearings 14,16 and the brake drum 22. The inner bearing 16 is forced over and beyond the knurls 40 so as to be able to rotate freely. The hollow cylinder 22 which forms the middle segment 32 is forced onto the knurls 40 which then hold the cylinder 22 rigidly in place. The outer bearing 14 does not pass over the knurls 40 but remains on the end of the shaft 38 where it may rotate freely. In this arrangement, the outside diameters of the bearings 14,16 and the brake drum 22 are equal.

Figure 5:
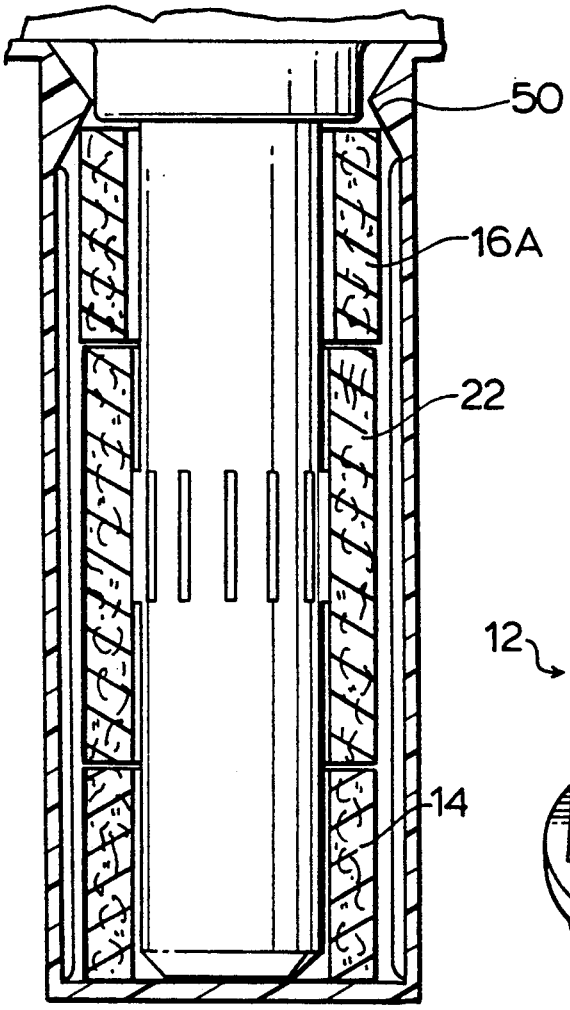
FIG. 5 is a partial sectional view of a preferred alternative embodiment of the invention.

In a preferred alternative arrangement, as shown in FIG. 5, the inner bearing 16A is formed of a hollow rigid cylinder of slightly larger inside and outside diameters than those of the other hollow cylinders 14,22. Having a larger inside diameter facilitates inserting the inner bearing 16A over the knurls 40, and similarly removing the inner bearing 16A if desired for replacement. Having a larger outside diameter provides an improved shoulder or seating to retain the flexible hand grip 18, as described below. Again, operator preference may also dictate an alternative combination of diameters.

Referring again to FIG. 1, the flexible hand grip 18 is similar to that described in U.S. Pat. No. 4,722,493. The hand grip 18 is formed of resilient plastics material, for example, polyvinyl chloride, and resembles a motorcycle hand grip. The hand grip 18 has a sleeve 42 which is closed at one end by an end cap 44 and open at the opposite end 46. At the open end 46 is an outwardly projecting circumferential flange 48 to protect the operator's hand from contacting the roll, and an inwardly projecting circumferential ridge 50.

The hand grip 18 covers the handle portion 26 of the spindle 12, the brake drum 22, and the outer and inner bearings 14,16. The ridge 50 causes a constriction in the opening 46 of the hand grip, which ridge 50 engages the leading or inner edge of the inner bearing 16. This engagement resists longitudinal movement of the hand grip 18 with respect to the spindle 12, and therefore prevents the hand grip 18 from sliding off the handle portion 26 and bearings 14,16. The end cap 44 prevents the outer bearing 14 from sliding off the shaft 38

The ridge 50 thus functions to prevent the dispenser from inadvertently disassembling during use. However, the ridge 50 is not so pronounced as to prevent the hand grip 18 from being manually installed onto and removed from the dispenser by way of assembly and disassembly. The ridge 50 is thus dimensioned with respect to the outside dimensions of the bearings 14,16 and brake drum 22 so that the hand grip 18 may be installed and removed with the application of manual force. A preferred arrangement, as shown in FIG. 5, is that the outside diameter of the inner bearing 16A be slightly greater than that of the brake drum 22 and the outer bearing 14 to maximize the degree of positive engagement between the ridge 50 and the inner bearing 16A without requiring application of significant force for installation and removal of the hand grip 18. An important advantage of the invention is that the dispenser may be used in an upside down position i.e. with the roll oriented downward without the dispenser disassembling.

The hand grip 18 is provided with a plurality of internal spaced longitudinal ribs 52, so that only the tips of the ribs engage the surface of the brake drum 22. The hand grip 18 is dimensioned to fit somewhat loosely at least over the brake drum 22 so that the spindle 12 rotates freely with respect to the hand grip 18 as long as no radial hand pressure is applied at the surface of the brake drum 22. If radial hand pressure is exerted on the hand grip 18 at the surface of the brake drum 22 as shown by arrows in FIG. 6, the ribs 52 are forced into contact with that surface.

In use, the dispenser is securely attached to the hollow core 20 of a roll of stretch-wrap film 10 by the hub being forcibly inserted into the core. The hub 28 is retained by frictional forces, while the longitudinal ridges 30 dig into and positively engage the core material and resist relative rotation. The leading edge of the film 54 is held against or attached to the objects being wrapped and the dispenser is moved around the objects while the film unwinds from the roll and is transferred to the objects. The dispenser may alternatively be held stationary and the objects rotated.

Figure 4:
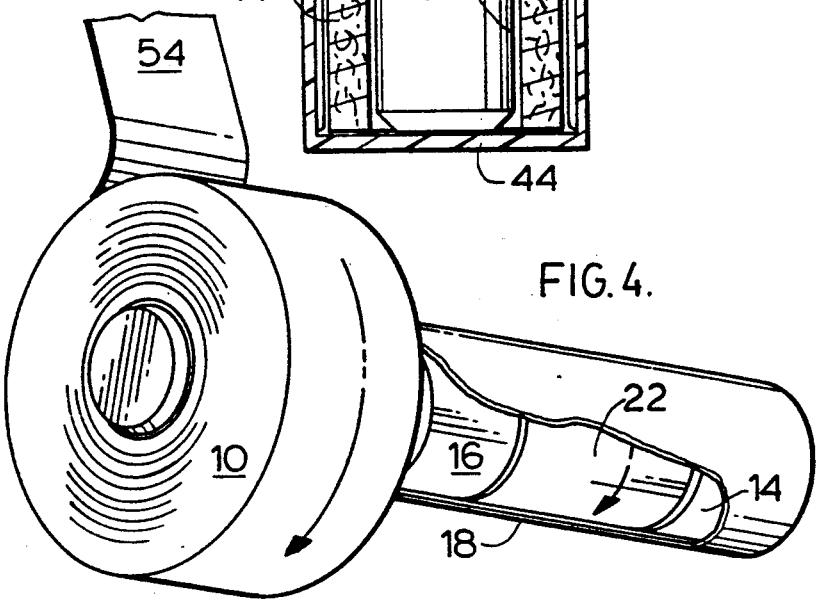
FIG. 4 is a perspective view partially cut away of the dispenser shown in FIG. 3 showing the direction of rotation.

As the film unwinds, the spindle 12 rotates along with the roll 10, as shown in FIG. 4. As long as no radial hand pressure is applied to the hand grip 18 at the surface of brake drum 22, the spindle 12 rotates freely with respect to the hand grip 18 by virtue of the inner and outer bearings 14,16 and the loose fit between the hand grip 18 and the brake drum 22 of the spindle 12, and the film unwinds easily. In this way, the film is dispensed substantially without any linear tension on the film, and the film does not stretch appreciably.

Figure 7:
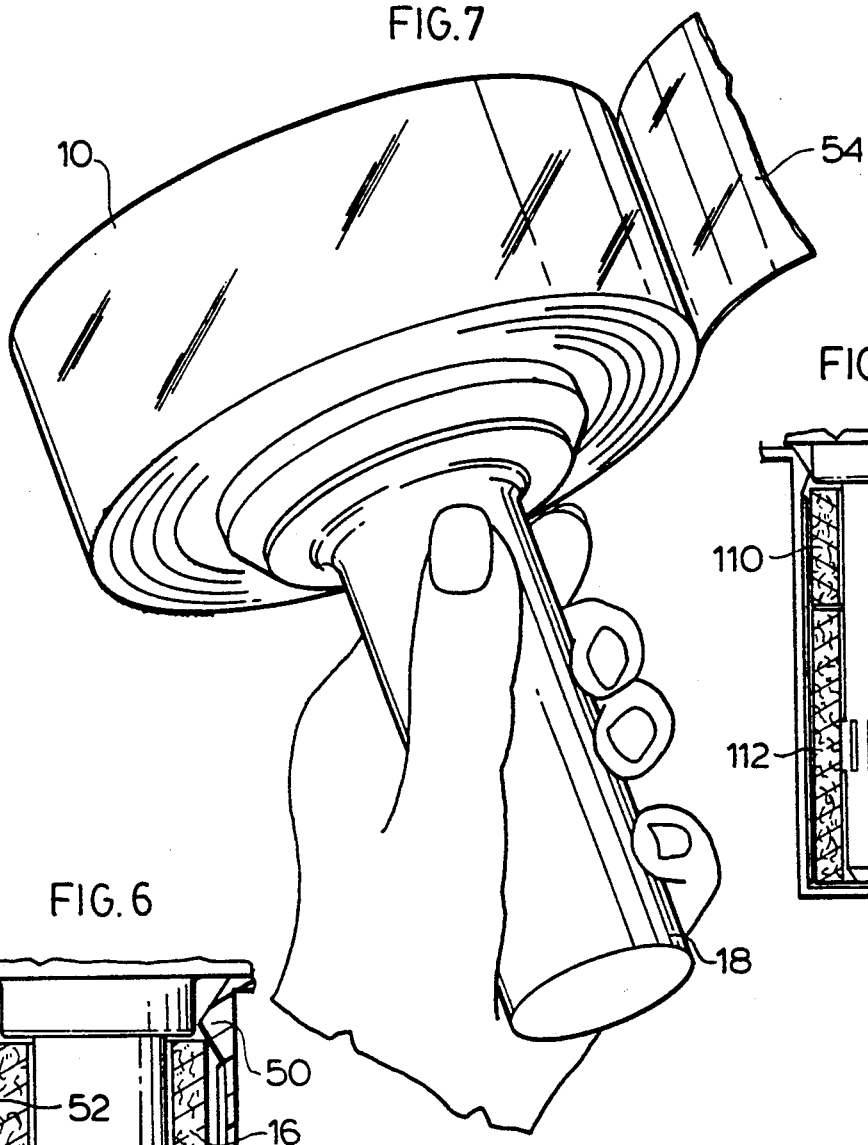
FIG. 7 is a perspective view of the dispenser shown in FIG. 3 showing the manner of grasping the dispenser for use.
Figure 6:
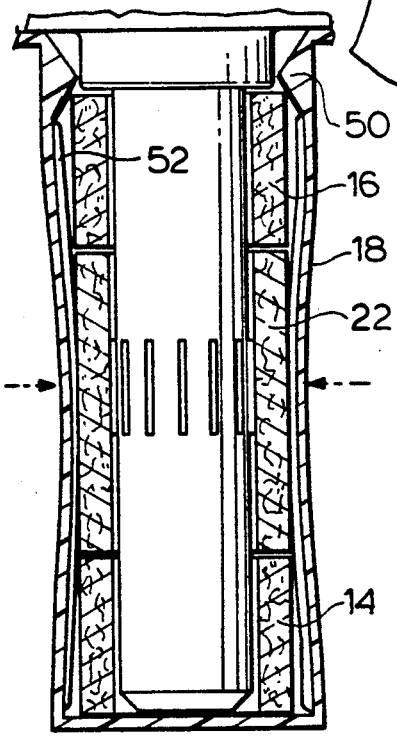
FIG. 6 is a partial sectional view of the dispenser shown in FIG. 3 showing the result of applying radial force.

In order to form a secure packaging, the film is stretched during application by applying tension on the unwinding end 54. In order to provide such tension, the operator grips the hand grip 18 as shown in FIG. 7, and applies radial hand pressure on the hand grip 18 at the surface of the brake drum 22 of the spindle 12. The radial hand pressure causes the hand grip 18 to deform, as shown in FIG. 6, and the longitudinal ribs 52 ar pressed into contact with the surface of the brake drum 22 creating frictional braking torque, that is, tangential frictional force between the ribs 52 and inner surface of the hand grip and the surface of the middle segment 32 which resists rotation of the spindle 12. This braking torque is transmitted through the spindle 12 to the roll of stretch-wrap film 10 resulting in a tangential counter force applied at the edge of the roll of film to the unwinding end 54 of the film.

Radial hand pressure applied to the hand grip 18 at the outer and inner bearings 14,16 may cause deformation of the hand grip 18, but no frictional force will be created because of the operation of the bearings. As a result, a strong grasp can be applied in retaining and using the dispenser, if required, independently of the amount of braking force applied. Furthermore, non-braking grasp may be applied at both ends of the hand grip, so that a strong grasp may be applied as required to resist a significant twisting torque without thereby increasing the braking force to an excessive magnitude. This prevents significant binding as was encountered in many prior art devices.

In the preferred embodiment of the invention, the braking surface of the dispenser is at the middle of the hand grip 18. In order to apply braking force, the operator applies radial hand pressure at that surface, which typically is the surface beneath the middle two or three fingers. Braking force is thus applied through the middle part of the hand which resists fatigue.

The central location of the braking surface provides other options for resisting operator fatigue. Braking force may be increased, when required, by increasing the magnitude of pressure applied by each finger over the braking surface, or by increasing the number of fingers over the braking surface and thereby the area through which the braking force is applied. The operator has a degree of latitude in arranging his grasp on the hand grip, and by altering his grasp periodically may avoid fatiguing one particular finger or another.

The operator also has the option of disassembling the handle portion 26 of the spindle 12 and installing a different arrangement of bearings and braking surface. This option may enable a particular operator to "set" the dispenser at an optimal arrangement for personal use, and/or to adjust the dispenser during a pause in use to alleviate fatigue.

Figure 8:
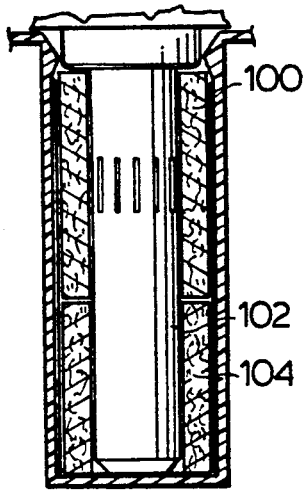
FIG. 8 is a partial sectional view of an alternative embodiment of the invention.

Alternative embodiments of the simplified dispenser may be constructed. In one alternative embodiment, as shown in FIG. 8, the inner bearing may be eliminated for even greater simplicity of manufacture and construction. There is thus only a first segment 100 of the handle portion of the spindle, which forms the braking surface, and a second segment 102 for coaxial engagement with a bearing means 104. The construction is otherwise similar to the embodiment with two bearings as described earlier. In use, the braking force is applied through the thumb and forefinger, while no braking force is applied by the rest of the hand because of the relative location of the bearing.

Figure 9:
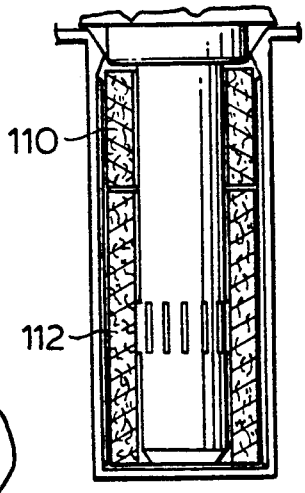
FIG. 9 is a partial sectional view of a further alternative embodiment of the invention.

In a further alternative embodiment shown in FIG. 9, the outer bearing has been eliminated. This alternative embodiment of the subject dispenser comprises inner bearing 110 and braking cylinder 112. It should be appreciated, however, that the alternative embodiments shown in FIG. 8 and FIG. 9, having a single bearing, may not necessarily function as well as the preferred embodiment of the subject dispenser having two bearings, especially during one-handed operation.

In other embodiments (not illustrated), different types of bearing means may be used, for example, roller bearings, or very thin-walled hollow cylinders formed of a slippery material such as teflon. Bearings of this latter type may be formed integrally with the flexible hand grip.

Variations may be introduced in the mode of construction of the dispenser described above without departing from the principle of the invention. For example, the spindle 12 may be constructed initially in the shape in which it appears in FIG. 2. Thus, the middle segment 32 of the handle portion 26 of the spindle 12 which provides the braking surface may be formed by an enlarged, integral part of the spindle rather than by insertion of a hollow cylinder onto a cylindrical shaft of uniform diameter, as described above with reference to FIG. 1 and FIG. 2. With such construction, different methods which are known in the art such as a split ring construction will be used to provide an inner bearing means to engage the inner segment of the spindle. Other substitutions of materials and of methods of construction are known and may be employed.

While this dispenser has been developed primarily for dispensing stretch-wrap film, it may equally have other uses without departing from the principle of the invention, for example, for dispensing adhesive tape or other web materials.

Further, while this dispenser is designed primarily for one-handed operation with small rolls of stretch film, it can also be used in conjunction with longer rolls of stretch film by placing one dispenser in each end of the core of the longer roll. In such two-handed applications, the brake drum of the subject dispenser would normally be made longer in order to apply greater tension to the wider film, depending upon the strength of the film. In the case of weaker films, the braking surface should be reduced, to prevent the film from breaking under braking force.

Other modifications in the construction or use of the simplified dispenser will readily occur to persons skilled in the art. The above description is illustrative of the invention, and a variety of modifications are possible without departing from the scope and spirit of the following claims.

THE EMBODIMENTS OF THE INVENTION IN WHICH AN EXCLUSIVE PROPERTY OR PRIVILEGE IS CLAIMED ARE DEFINED AS FOLLOWS:

1. A dispenser for a roll of stretch film having a core, said dispenser comprising a spindle having a substantially cylindrical shaft and an integral hub at one of the shaft, said hub being adapted for insertion into the core of the film roll and having means thereon for preventing relative rotation between the core and the hub, a first sleeve bearing mounted coaxially upon the shaft adjacent said hub, and freely rotatable upon the shaft, a brake drum mounted coaxially upon the shaft with one end longitudinally adjacent the first sleeve bearing, means constraining the brake drum to rotate in unison with said shaft, a second sleeve bearing mounted coaxially upon the shaft longitudinally adjacent the other end of said brake drum, said second sleeve bearing being freely rotatable upon the shaft, and a single flexible hand grip having a tubular portion surrounding both of said sleeve bearings and said brake drum, said grip, when relaxed, being out of contact with said brake drum, but coming into contact with the brake drum, to resist rotation of the spindle, when finger pressure is applied to the grip against the brake drum, but not when finger pressure is applied to the grip only against the sleeve bearings.

2. The dispenser of claim 1 wherein the the brake drum is a hollow cylinder rigidly secured to the shaft.

3. The dispenser of claim 2 wherein longitudinal knurls on the shaft positively engage the inside surface of the cylinder.

4. The dispenser of claim 2 wherein the length of the brake drum is about twice the length of either of the sleeve bearings.

5. The dispenser of claim 2 wherein the length of the brake drum is in the range of 1½ to 2 inches, and the length of each sleeve bearing is in the range of ¾ to 1 inch.

6. The dispenser of claim 2 wherein the hub and shaft of the spindle are of rigid plastic material and the brake drum and sleeve bearings are of cardboard core material.

7. The dispenser of claim 1 wherein the hand grip comprises an external flange at the end thereof adjacent the roll to prevent hand-to-roll contact.

8. The dispenser of claim 1 wherein the hand grip has a closed end at the end furthest from the roll.

9. The dispenser of claim 1 wherein the hand grip comprises means for resisting longitudinal movement of the hand grip with respect to the spindle.

10. The dispenser of claim 9 wherein the means for resisting longitudinal movement is an internal circumferential ridge which engages the leading edge of the inner bearing means.

11. The dispenser of claim 1 wherein the outside diameter of the sleeve bearings is slightly greater than the outside diameter of the brake drum.

12. The dispenser of claim 1 wherein the hand grip has a plurality of internal longitudinal ribs disposed only around said brake drum.

13. The dispenser of claim 1 wherein the hub has an outside diameter slightly larger than the inside diameter of the core of the roll whereby the hub may be forcibly inserted into the core for a friction engagement therewith.

14. The dispenser of claim 13 wherein the hub has longitudinal ridges for positive rotational engagement with the core.

* * * * *